United States Patent [19]

Glime

[11] Patent Number: 4,637,332

[45] Date of Patent: Jan. 20, 1987

[54] PIVOTAL MOTOR MOUNT

[76] Inventor: Fred W. Glime, 30640 Balewood, Southfield, Mich. 48076

[21] Appl. No.: 769,828

[22] Filed: Aug. 27, 1985

Related U.S. Application Data

[63] Continuation of Ser. No. 381,522, May 24, 1982, abandoned.

[51] Int. Cl.[4] ..... B63H 21/26

[52] U.S. Cl. ..... 114/61; 440/53; 440/55; 248/642

[58] Field of Search ..... 440/53, 55, 900; 248/640, 641, 642, 643; 114/61

[56] References Cited

U.S. PATENT DOCUMENTS 2,507,613 5/1950 Reid ..... 248/641
4,025,010 5/1977 Soot ..... 248/641
4,077,353 3/1978 Webb ..... 248/641
4,227,480 10/1980 Carras ..... 248/642

*Primary Examiner*—Sherman D. Basinger
*Assistant Examiner*—Thomas J. Brahan
*Attorney, Agent, or Firm*—Cullen, Sloman, Cantor, Grauer, Scott & Rutherford

[57] ABSTRACT

The present invention relates to a motor support for an outboard motor for use on a twin-hull sailboat or catamaran. The support has a first member which is fixedly attached to either the forward or rearward cross-bars of the catamaran and a second member pivotally attached to the first member which supports the motor. The pivotal attachment allows the second member to pivot with respect to the first member about a longitudinal axis parallel to the center line of the sailboat.

5 Claims, 7 Drawing Figures

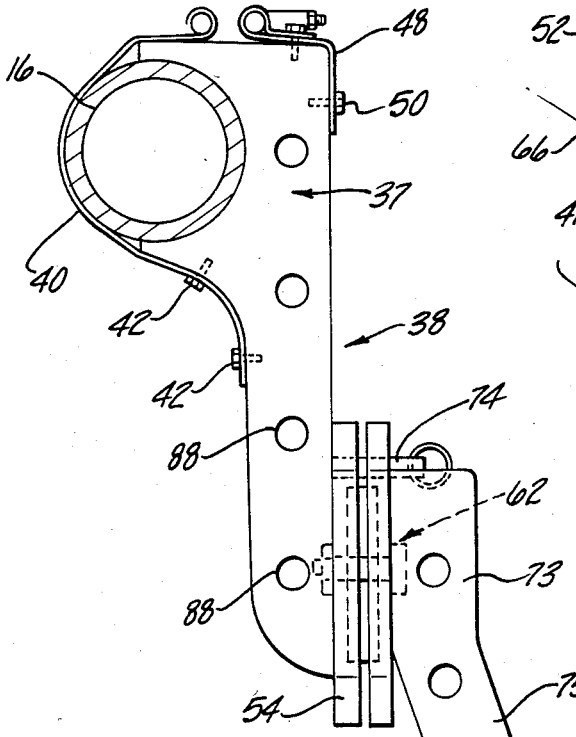
Fig-3
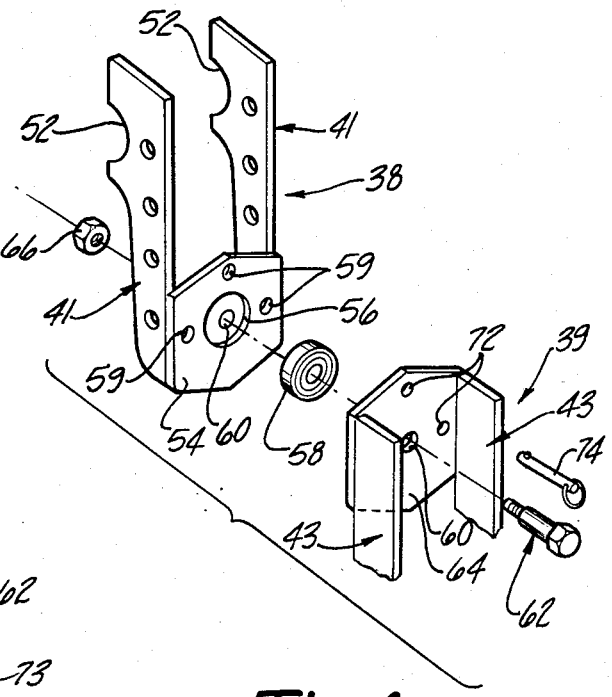
Fig-4
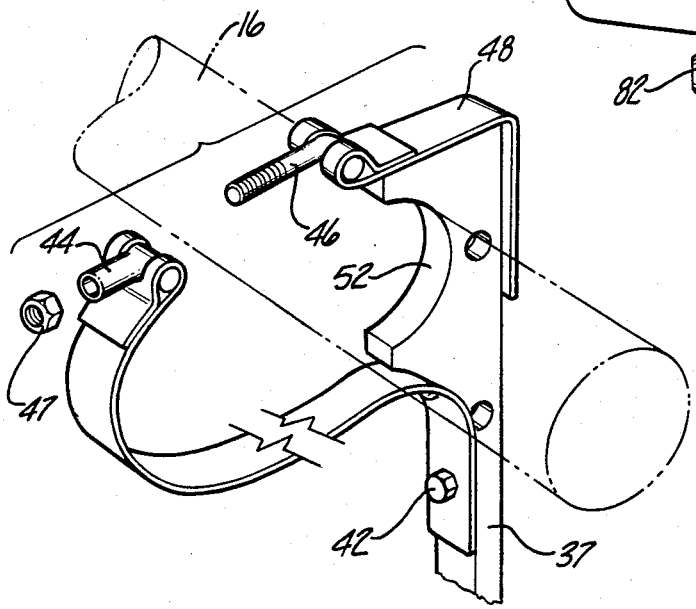
Fig-5
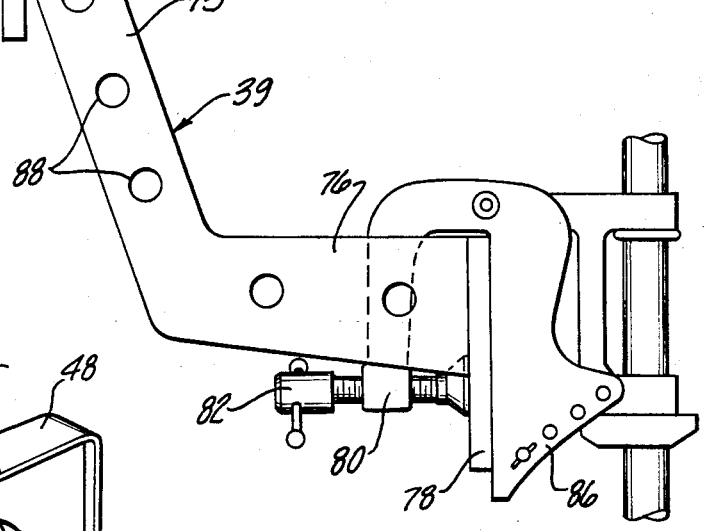

PIVOTAL MOTOR MOUNT

BACKGROUND OF THE INVENTION

This is a continuation of U.S. patent application Ser. No. 381,522, filed May 24, 1982, entitled "Catamaran Motor Mount", now abandoned.

Twin-hull sailboats or catamarans as they are commonly called have become popular for sport and recreation. This popularity is due in part to their being extremely lightweight which permits high speed and quick response with very little wind, being relatively easy to maintain, and being comparatively inexpensive.

Catamarans generally have twin-hulls or pontoons supported below a lightweight tubular frame that is generally made of aluminum. The frame has two cross-bars, one adjacent the bow and one adjacent the stern, and two side bars joining the cross-bars forming a substantially square frame. A cloth material, as for example canvas, is stretched across the frame to form a deck. A mast and sail connected to the forward cross-bar provides propulsion with direction being controlled by rudders located at the boat's stern.

Catamaran sailboats are totally dependent on the wind for propulsion. When the wind dies, the catamaran stops. Thus, if the boat is a long distance from shore a sailor may be stranded until the wind picks up. In emergencies, there may be a problem returning to shore quickly and even if there is a wind, any interruption may result in serious consequences. Catamarans are also difficult to dock because the only propulsion available is the wind.

To overcome these problems, a propulsion means is needed, such as an outboard motor, that will not interfere with sailing when there is a good wind, but will be available when the wind dies. However, due to the construction of catamarans, providing a stored, readily accessible outboard motor is not easy. First, there is virtually no place to store the motor and second, there is little space available to attach the motor for use.

U.S. Pat. No. 4,227,480 discloses a motor mount bracket for twin-hull sailboats. The bracket is attached to the cross-bar adjacent the stern. A pivot arm is pivotally attached at one end to the bracket and has the motor attached at the opposite end permitting the motor to be pivoted about an axis perpendicular to the center line of the boat between a stowed position and a position where the motor is in the water. In the stowed position, a cam block is placed underneath the arm to support it at an angle relative to the water's surface. To put the motor in the water, the cam block is removed and the motor is lowered about the perpendicular axis.

Having the motor at the end of the pivot arm creates several difficulties, as for example, the arm is difficult to pivot upwardly because the weight of the motor is at the opposite end, torsional stress is induced into the lightweight cross-bar because of the long moment arm, the long moment arm shifts the boat's balance and the motor in the stowed position reduces the aesthetic appeal of the boat.

BRIEF DESCRIPTION OF THE PREFERRED EMBODIMENT

The present invention overcomes the above disadvantages by providing a motor support having first and second members pivotally attached at adjacent ends. The second member or lower member pivots with respect to the first member about an axis parallel to the center line of the sailboat between a first position or stored position wherein the motor is substantially parallel to the cross-bar and a second position or use position wherein the motor is substantially perpendicular to the cross-bar.

The adjacent ends of the first and second members have pivot plates attached thereon. The pivot plates support a pivot axis to permit pivotal movement of the second member with respect to the first member. Each of the plates have corresponding apertures for receipt of a locking means for selectively locking the second member in the use or stored positions.

In one embodiment, the first member has first and second spaced apart substantially vertical arms. In a second embodiment, the first member has first and second spaced apart substantially horizontal arms. Each arm in each embodiment has a first end which forms a clamping region for clamping to the cross-bar and an opposite end which is connected to the pivot plate.

The second member has the pivot plate at its upper end and a motor mounting plate at its lower end. The second member is designed so that its upper region is angled relative to the first member and its lower region extends outwardly in a direction substantially parallel to the center line of the boat. The configuration of both the first and second members permits the pivotal mounting means to be used on either cross-bar. Further, due to the configuration of the arms and the pivotal mounting system, the motor remains tightly adjacent the cross-bar in both the use and stored positions.

The pivotal mounting means of the present invention allows for easy accessibility of the motor since the motor can be easily pivoted about the longitudinal axis. The mounting means does not radically alter the balance of the boat since it is held tightly adjacent the cross-bar and, the mounting is aesthetically appealing.

BRIEF DESCRIPTION OF THE DRAWINGS

FIG. 3 is a side view of the pivotal mounting means of the present invention in the use position.

FIG. 4 is a partial exploded view of the pivotal mounting means of the present invention.

FIG. 5 is a partial perspective view of the clamping region.

DETAILED DESCRIPTION OF THE PREFERRED EMBODIMENT

Figure 1:
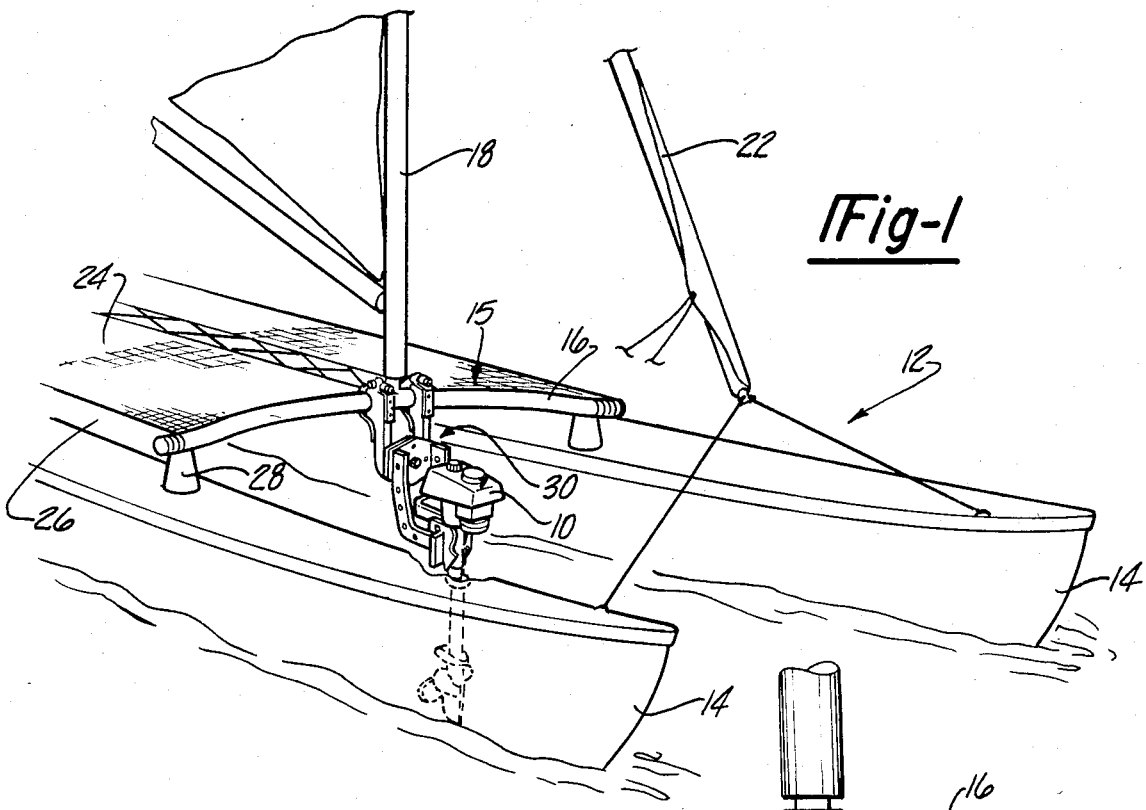
FIG. 1 is a partial cutaway view of a catamaran sailboat employing the pivotal mounting means of the present invention in the use position.

With reference to FIG. 1, a twin-hulled sailboat, commonly referred to as a catamaran, is illustrated at 12. Catamaran 12 has first and second pontoons 14 supported below a lightweight tubular frame 15. Tubular frame 15 has two cross-bars 16, one adjacent the bow and one adjacent the stern with two side bars 26 joining the cross-bars. A cloth material 24, as for example canvas, is stretched across frame 15 to form a deck. A mast 18 and sail 20 are fixed to the forward cross-bar for providing propulsion. Rigging 22 supports the mast and sail. Direction of catamaran 12 is controlled by rudders located at the boat's stern (not shown).

Figure 2:
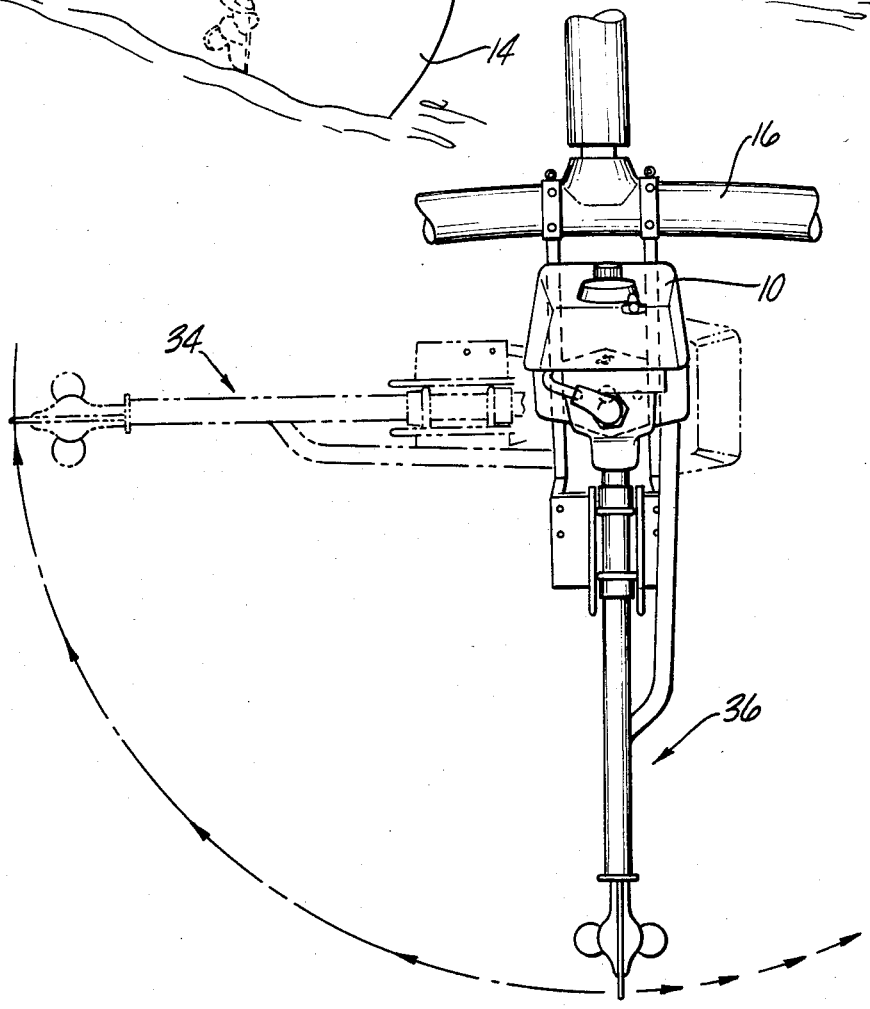
FIG. 2 is a plan view of the pivotal mounting means illustrating the motor in the use position and the stored position.
Figure 6:
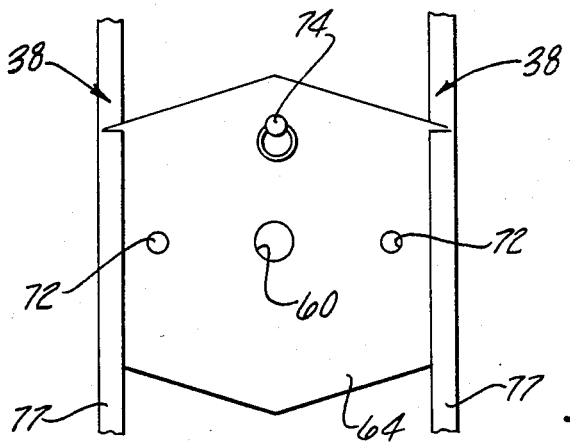
FIG. 6 is a partial plan view of the pivot plate.

Auxillary propulsion is provided by an outboard motor 10 which is pivotally mounted to catamaran 12 by a motor mount 30. Mount 30 permits motor 10 to pivot about a longitudinal axis 32 which extends from the bow to the stern of the boat. With reference to FIG. 2, motor 10 is shown in a first position 34, wherein motor 10 is horizontal and parallel to cross-bar 16 and a second position 36, wherein motor 10 is perpendicular to cross-bar 16.

Motor mount 30 may be attached to either cross-bar 16. Mount 30 has a fixed support member 38 having parallel opposed support arms 41 and a swivel support member 39 having parallel opposed support arms 43. Members 38 and 39 are pivotally mounted at adjacent ends by a mounting means which will be described below. Member 38 is clamped to cross-bar 16 at a clamping portion 37 having a recessed section 52 adjacent bar 16 and an opposed retaining band 40 which wraps around bar 16 and is lockable at the upper portion of member 38. The upper portion of band 40 has a sleeve 44 for receipt of a clamping bolt 46. Nut 47 retains bolt 46 in sleeve 44 and provides adjustment for retaining band 40. Bolt 46 is held in place by L-shaped bracket 48 and bolts 50. In this manner, member 38 is fixedly attached to bar 16 and can be easily removed and replaced without any alterations to the boat. Other methods of clamping member 38 to the cross-bar 16 are within the intended scope of this invention, as for example, using an over top-dead center clamp or a C-clamp, etc.

At the lower end of arm 38, a first pivot plate is attached, as for example by bolting or welding. The pivot plate has a bearing seat 56 for receipt of a bearing 58, as for example a roller bearing. Radially spaced outwardly from the bearing seat 56 are three openings 59.

A second pivot plate 64 is pivotally attached to plate 54 by a pivot pin 62 received within aperture 60. A nut 66 retains pin 62 in place.

Openings 72 in plate 64 align with openings 59 when the second member is in the first or second positions respectively. A locking pin 74 is receiveable within openings 59 and 72 to lock member 39 in place with respect to member 37. To pivot member 39, locking pin 74 is released from openings 59 and member 39 is pivoted to either the use or stored positions about pin 62.

With reference to FIG. 3, the preferred embodiment of member 39 is configured to have a first vertical portion 73 connected to pivot plate 64, a middle section 75 which is angled with respect to section 73 and a horizontal end section 76 which has motor mounting plate 78 attached thereon, as for example, by welding or bolting. A transom clamp 80 mounted to the motor 10 is clamped to the plate 78 by a clamp screw 82. The motor may be trim adjusted by trim-adjustment clamp 86. In the preferred embodiment, all four arms of motor mount 30 have holes 88 therein to reduce weight. Mount 30 can be constructed of aluminum or other high strength materials.

Figure 7:
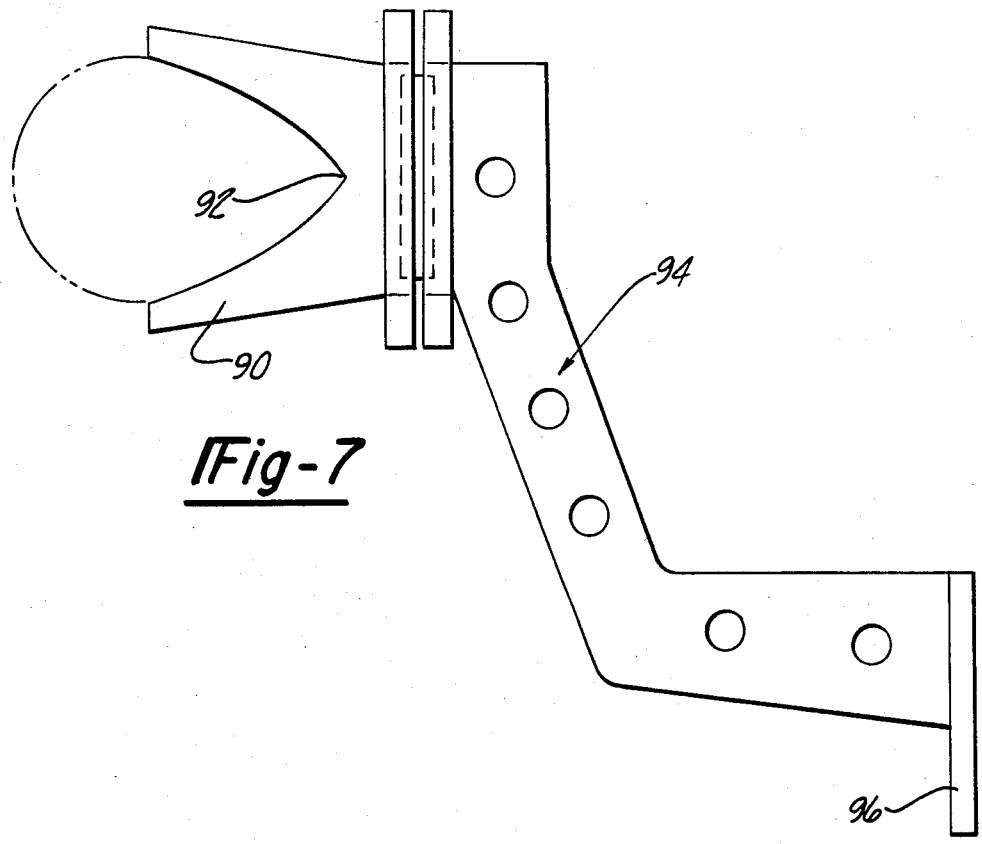
FIG. 7 is a side view of the second embodiment of the present invention.

With reference to FIG. 7, a second embodiment of the present invention is illustrated. Fixed support member 38 is replaced by a clamping portion 90 having a V-shaped recess 92. The clamping portion 90 of the present embodiment is for use on catamarans with cross-bars having a different configuration than those utilized in the first embodiment. As is apparent, the motor is not as far below the cross-bar as the motor in the first embodiment. This embodiment has a swivel support arm 94 that is substantially the same as that in the previous embodiment as well as a motor mount plate 96. The operation of this mount is substantially the same as that described above.

It will be apparent to those skilled in the art that the foregoing disclosure is explanatory in nature rather than limiting, the invention being limited only by the appended claims.

What is claimed is:

1. A motor supported for supporting a motor on a twin-hull sailboat, said boat having a center line with first and second spaced apart parallel hulls extending along said center line, said hulls being supported by first and second spaced apart parallel cross-bars positioned perpendicular to said center line, said first cross-bar being positioned approximate the bow of said boat and said second cross-bar being positioned approximate the stern of said boat, said motor support comprising:

an upper member and a lower member pivotally connected at adjacent ends by a coupling means;

said coupling means including a first pivot plate mounted to said upper member and a second pivot plate mounted to said lower member, said plates being coupled to permit pivotal movement of said lower member with respect to said upper member;

said upper member including a bracket means opposite said pivot plate, said bracket means having a shape complimentary to and adapted for rigid attachment to one of said first and second cross-bars;

said lower member including spaced apart substantially parallel arms interconnected by said second pivot plate and extending substantially downwardly therefrom with said opposite end of said lower member being adapted to support said motor means;

said lower member being pivotable with respect to said upper member about an axis substantially parallel to said center line between a first position wherein said second member is substantially parallel to said cross-bar, whereby said motor is in a non-use, stand-by position and a second position, wherein said second member is substantially perpendicular to said cross-bar, whereby said motor is in a use position and operable to propel said boat.

2. The motor support of claim 1, wherein said upper member comprises a fixed support arm extending downwardly from and substantially perpendicular to said cross-bar.

3. The motor support of claim 1, wherein said upper member comprises a fixed support arm extending outwardly from said cross-bar and substantially parallel to said center line, said support arm having one end fixedly attached to said cross-bar, said opposite end being pivotally connected to said second member.

4. The motor support of claim 1, wherein said bracket means further includes a retaining means having first and second bands, said first band wrapping around said cross-bar, having one end affixed to one side of said upper member with the free end adapted to adjustably fasten to the free end of said second band, the opposite end of said second band being affixed to the opposite side of said upper member.

5. The motor support of claim 1, wherein said first and second pivot plates are supported on a pivot axis, with each of said plates having corresponding apertures therein for receipt of a locking means whereby said second member can be locked in said first or second positions with respect to said first member.

* * * * *